US010562685B2

(12) United States Patent
Blin

(10) Patent No.: US 10,562,685 B2
(45) Date of Patent: Feb. 18, 2020

(54) CARTON AND CARTON BLANK

(71) Applicant: Westrock Packaging Systems, LLC, Norcross, GA (US)

(72) Inventor: Patrick Blin, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 171 days.

(21) Appl. No.: 15/323,640

(22) PCT Filed: Jun. 24, 2015

(86) PCT No.: PCT/US2015/037357
§ 371 (c)(1),
(2) Date: Jan. 3, 2017

(87) PCT Pub. No.: WO2016/007289
PCT Pub. Date: Jan. 14, 2016

(65) Prior Publication Data

US 2017/0158402 A1 Jun. 8, 2017

(30) Foreign Application Priority Data

Jul. 9, 2014 (GB) ..... 1412186.7

(51) Int. Cl.
*B65D 71/18* (2006.01)
*B65D 71/22* (2006.01)

(52) U.S. Cl.
CPC ..... *B65D 71/18* (2013.01); *B65D 71/22* (2013.01); *B65D 2571/0066* (2013.01);
(Continued)

(58) Field of Classification Search
CPC .. B65D 2571/00141; B65D 2571/0066; B65D 2571/00716; B65D 71/22;
(Continued)

(56) References Cited

U.S. PATENT DOCUMENTS 3,593,849 A * 7/1971 Helms ..... B65D 71/16 206/193
1,265,553 A 3/1972 Stout
(Continued)

FOREIGN PATENT DOCUMENTS

EP 0887280 A1 * 12/1998 ..... B65D 71/36
EP 0887280 A1 12/1998
(Continued)

*Primary Examiner* — Nathan J Newhouse
*Assistant Examiner* — Matthew T Theis
(74) *Attorney, Agent, or Firm* — WestRock Intellectual Property Group

(57) ABSTRACT

A package includes a carton (90) and one or more articles (A). The carton includes a top panel (20), a base panel (16), a first side wall (14) and a second side wall (18). The first side wall includes at least one tab (42*a*) hingedly connected thereto. The at least one tab is configured to provide a support structure for facilitating stacking of the carton. The at least one tab has a lower edge in contact with an upper surface of an article and includes an upper edge in contact with an inner surface of the top panel of the carton so as to support the top panel of the carton above the upper surface of the article.

16 Claims, 18 Drawing Sheets

(52) U.S. Cl.
CPC ..... *B65D 2571/00141* (2013.01); *B65D 2571/00265* (2013.01); *B65D 2571/00271* (2013.01); *B65D 2571/00716* (2013.01); *B65D 2571/00839* (2013.01); *B65D 2571/00895* (2013.01)

(58) Field of Classification Search
CPC ..... B65D 71/18; B65D 2571/00839; B65D 2571/00895; B65D 2571/00271; B65D 2571/00265
USPC ..... 229/103.2, 166, 170, 915, 918, 919
See application file for complete search history.

(56) References Cited

U.S. PATENT DOCUMENTS

| | | | | | |
|---|---|---|---|---|---|
| 4,545,485 | A | | 10/1985 | Oliff | |
| 4,875,586 | A | * | 10/1989 | Chaussadas | B65D 71/16 206/427 |
| 5,513,753 | A | | 5/1996 | Jensen | |
| 5,542,536 | A | * | 8/1996 | Sutherland | B65D 71/36 206/140 |
| 2007/0000794 | A1 | | 1/2007 | Requena | |
| 2007/0017829 | A1 | * | 1/2007 | Sutherland | B65D 71/16 206/170 |
| 2012/0267426 | A1 | | 10/2012 | Hendricks | |

FOREIGN PATENT DOCUMENTS

| | | |
|---|---|---|
| WO | WO 97/28051 | 8/1997 |
| WO | WO2008/063862 A2 | 5/2008 |

* cited by examiner

CARTON AND CARTON BLANK

CROSS-REFERENCE TO RELATED APPLICATIONS

This application is a National Phase application of PCT Application PCT/US15/37357, filed Jun. 24, 2015, which claims the benefit of United Kingdom Application No. 1412186.7, filed Jul. 9, 2014, which is incorporated herein by reference in its entirety.

FIELD OF THE INVENTION

The present invention relates to a carton for packaging articles and a blank for forming a carton more specifically, but not exclusively, to a carton comprising a support device for protecting an article dispenser.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is known to provide brick-shaped packages, such as those made by Tetra Pak™. Such packages, in particular packages having an inclined or sloping top panel, present problems when stacking for distribution or display. Such packages may include an access means, which may be in the form of a re-useable closure. These access means further complicate the problem of stacking packages one upon another. Such closures protrude from a surface of the package and are vulnerable to damage or tampering. It is an object of the present invention to provide a carton which protects the closure, allows the packages to be stacked and additionally may improve the security of the package.

The present invention seeks to overcome or at least mitigate the problems of the prior art.

SUMMARY OF INVENTION

According to a first aspect of the present invention there is provided a package comprising a carton and one or more articles, the carton comprising a top panel, a base panel, a first side wall and second a side wall, the first side wall comprising at least one tab hingedly connected thereto, the at least one tab being configured to provide a support structure for facilitating stacking of the carton, the at least one tab having a lower edge in contact with an upper surface of an article and comprising an upper edge in contact with an inner surface of the top panel of the carton so as to support the top panel of the carton above the upper surface of the article.

Optionally, the at least one tab comprises a first portion hinged to the first side wall and a second portion hinged to the first portion and to the top panel.

The carton may comprise a lower end closure panel for at least partially closing an end of the carton, the lower end closure panel being hinged to an anchor panel for holding the lower end closure panel in an erected position.

Optionally, the lower end closure panel is hinged to the anchor panel by a web panel.

In some embodiments, the anchor panel comprises a recess for accommodating the at least one tab when folded internally of the carton.

The carton may comprise a first brace panel and a second brace panel configured to form a V-shaped structure between the upper surface of the article and an inner surface of the top panel of the carton.

Optionally, the one or more articles comprise an inclined top panel.

Optionally, the one or more articles comprise a top panel and a dispenser mounted to an outer surface of the top panel.

According to a second aspect of the present invention there is provided a carton for packaging one or more articles, the carton comprising a top panel, a base panel, a first side wall and a second side wall, the carton comprising a support structure for facilitating stacking of the carton, the support structure comprising a first tab hinged to the first side wall and a second tab hinged to the first side wall in opposition to the first tab, each of the first and second tabs having a lower edge for being disposed in contact with an upper surface of an article and an upper edge for being disposed in contact with an inner surface of the top panel of the carton for supporting the top panel of the carton above the upper surface of the article.

Optionally, the first tab comprises a first portion hinged to the first side wall and a second portion hinged to the first portion and hinged to the top panel.

In some embodiments, the second tab comprises a first portion hinged to the first side wall and a second portion hinged to the first portion and hinged to the top panel.

The carton may comprise a lower end closure panel for at least partially closing an end of the carton, the lower end closure panel being hinged to an anchor panel for holding the lower end closure panel in an erected position.

Optionally, the lower end closure panel is hinged to the anchor panel by a web panel.

In some embodiments, the anchor panel comprises a recess for accommodating the first tab when folded internally of the carton.

Optionally, the carton comprises a first brace panel and a second brace panel configured to form a V-shaped structure between the upper surface of the article and an inner surface of the top panel of the carton.

According to a third aspect of the present invention there is provided a blank for forming a carton comprising a plurality of main panels hinged one to the next in a linear series, the plurality of panels forming a top panel, a base panel, a first side wall and a second side wall in a set-up a carton, the blank comprising a support structure for facilitating stacking of the carton, the support structure comprising a first tab hinged to the first side wall and a second tab hinged to the first side wall in opposition to the first tab, each of the first and second tabs having a lower edge for being disposed in contact with an upper surface of an article and an upper edge for being disposed in contact with an inner surface of the top panel of the carton for supporting the top panel of the carton above the upper surface of the article.

In some embodiments, the plurality of panels comprises a first top panel and a second top panel for being disposed in at least partially overlapping relationship to form a composite top panel in a set-up carton.

Optionally, the plurality of panels comprises a first brace panel and a second brace panel for forming a V-shaped bracing structure in a set-up carton.

Optionally, the first brace panel is hinged to the first top panel and the second brace panel is hinged to the first brace panel.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 2:
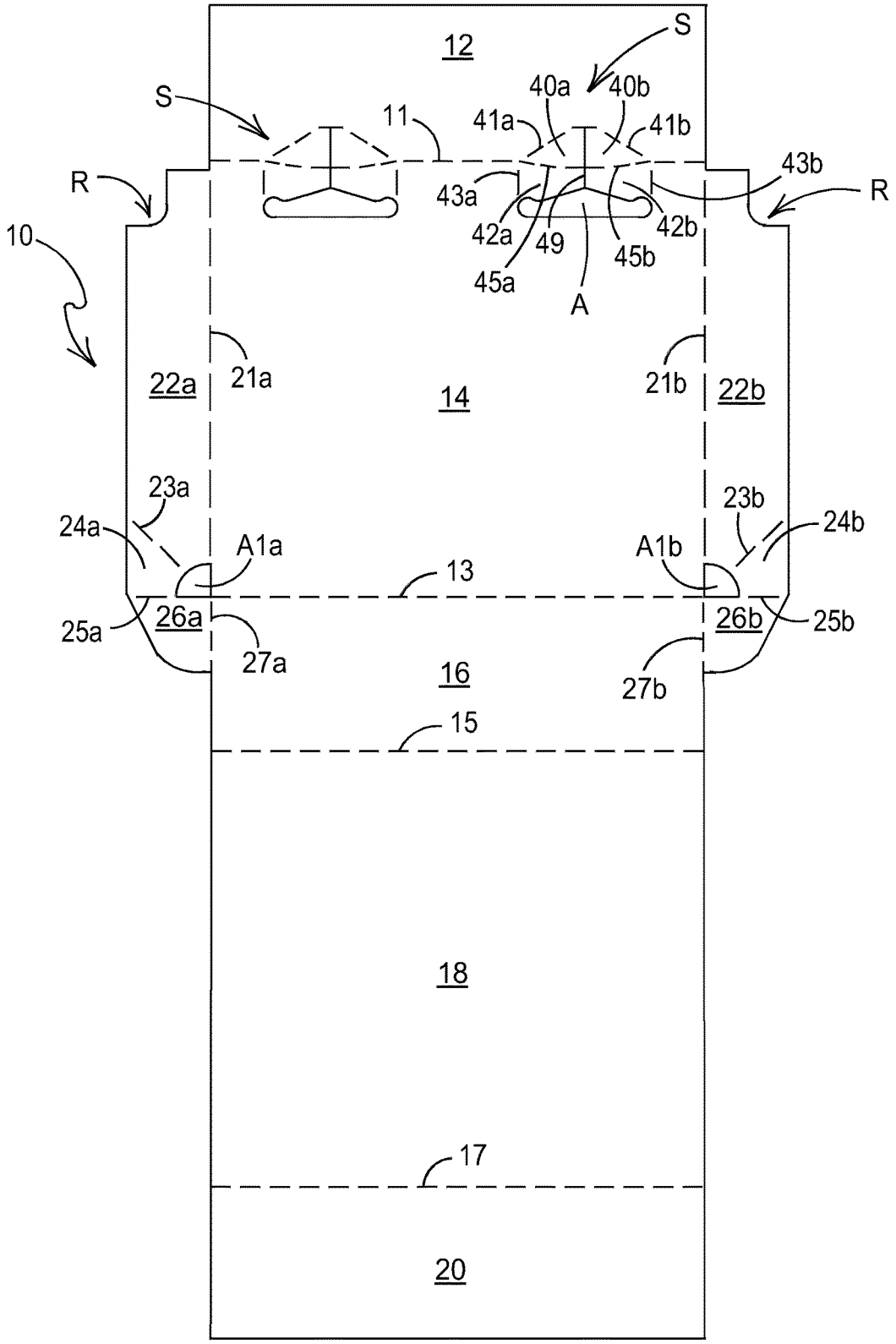
FIG. 2 is a plan view from above of a blank for forming a carton according to a first embodiment.
Figure 3:
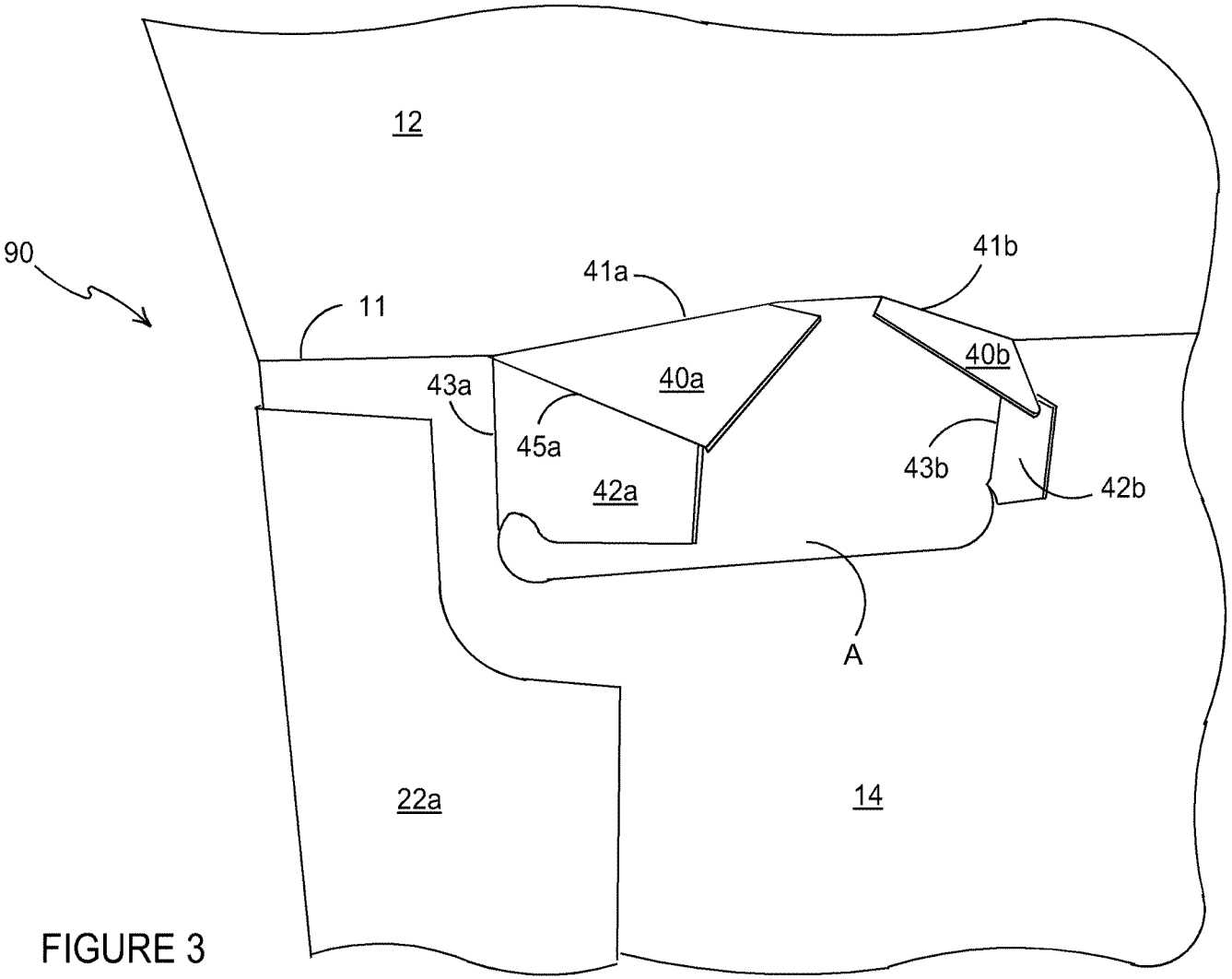
FIG. 3 is a perspective view, from inside, of a portion of the blank of FIG. 1 in a state of partial erection into a carton.
Figure 4:
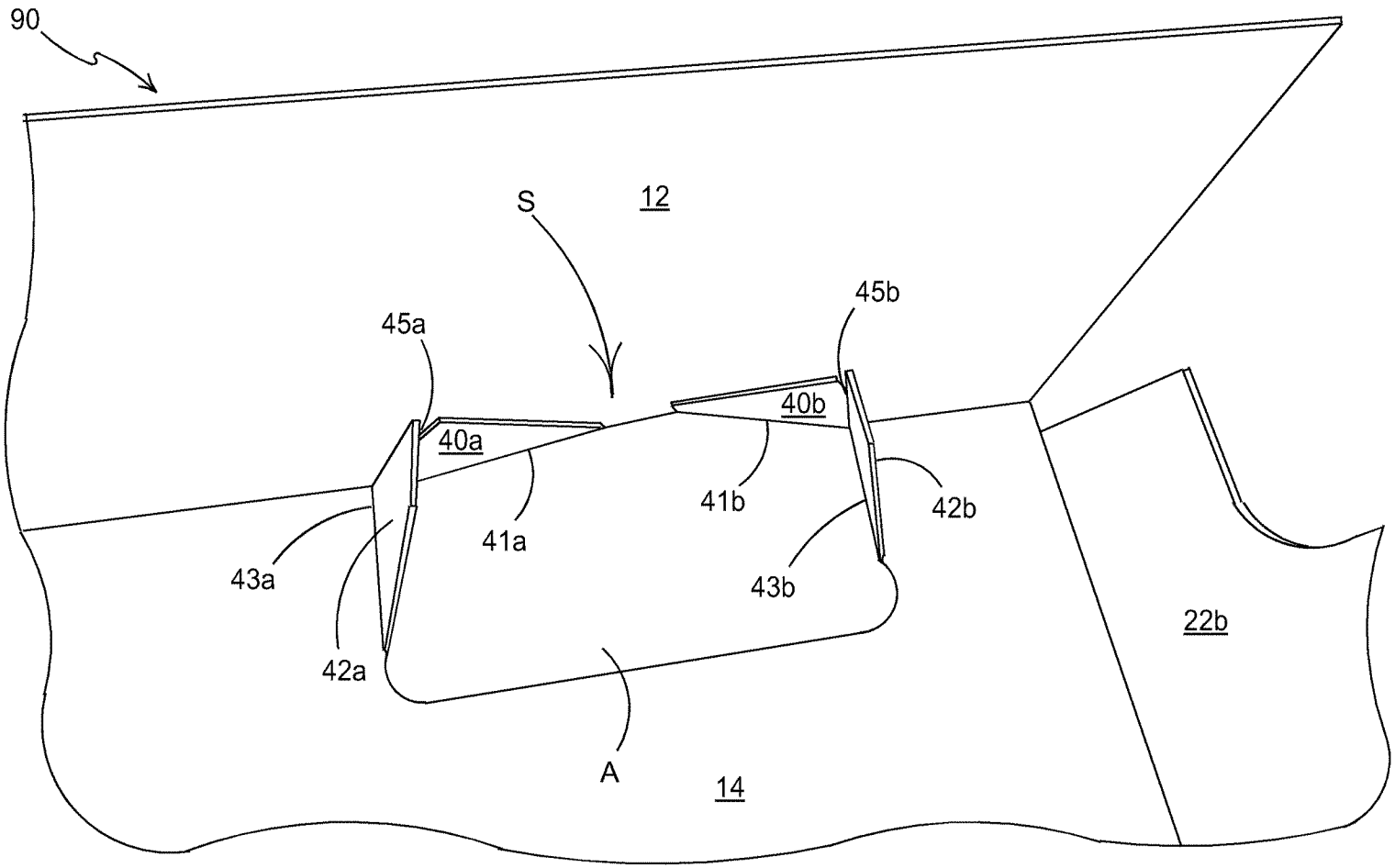
FIG. 4 is a perspective view, from inside, of a further portion of the blank of FIG. 1 in a state of partial erection into a carton.
Figure 5:
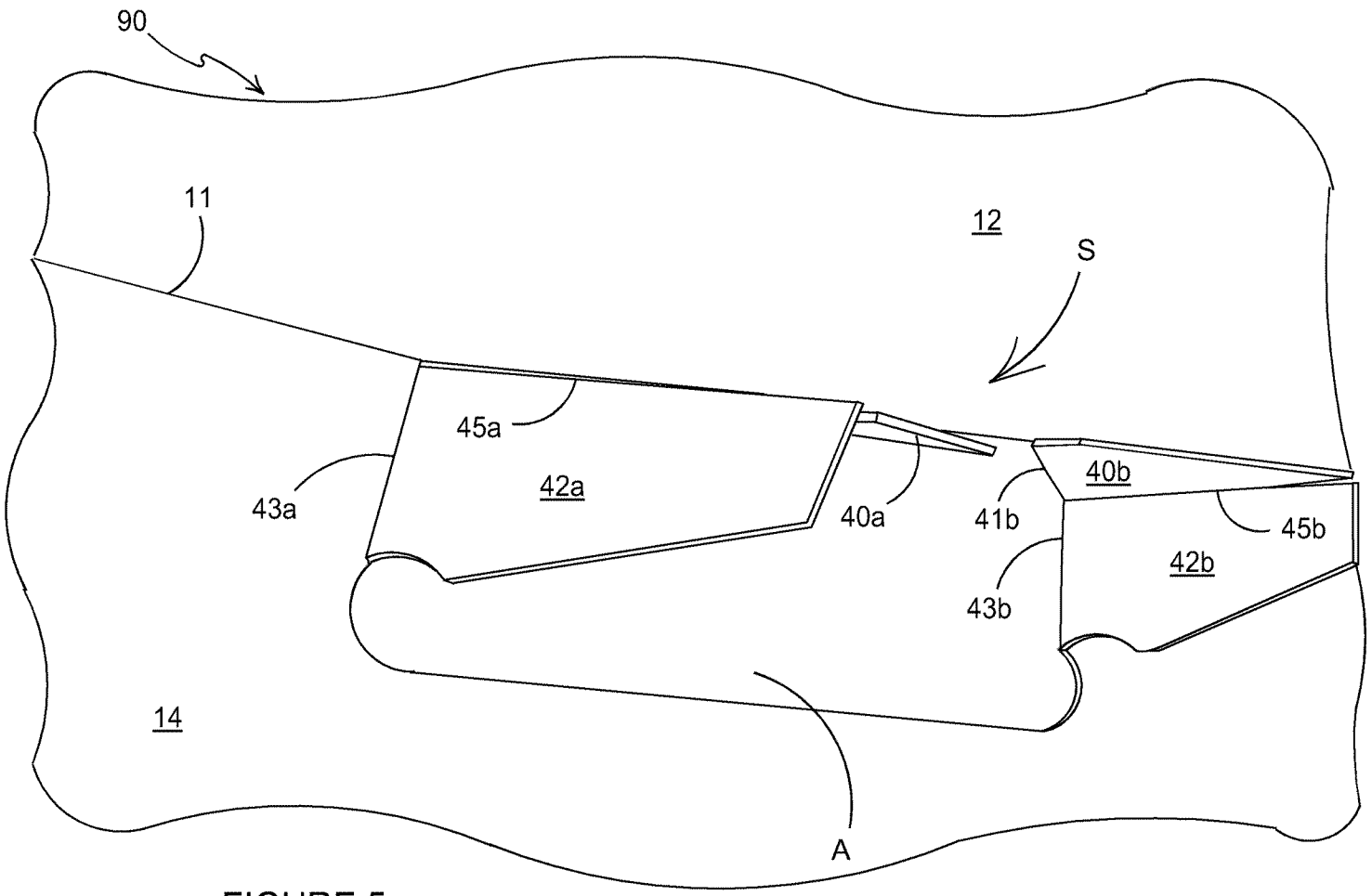
FIG. 5 is a perspective view, from inside, of a spacer device in an erected state.
Figure 6:
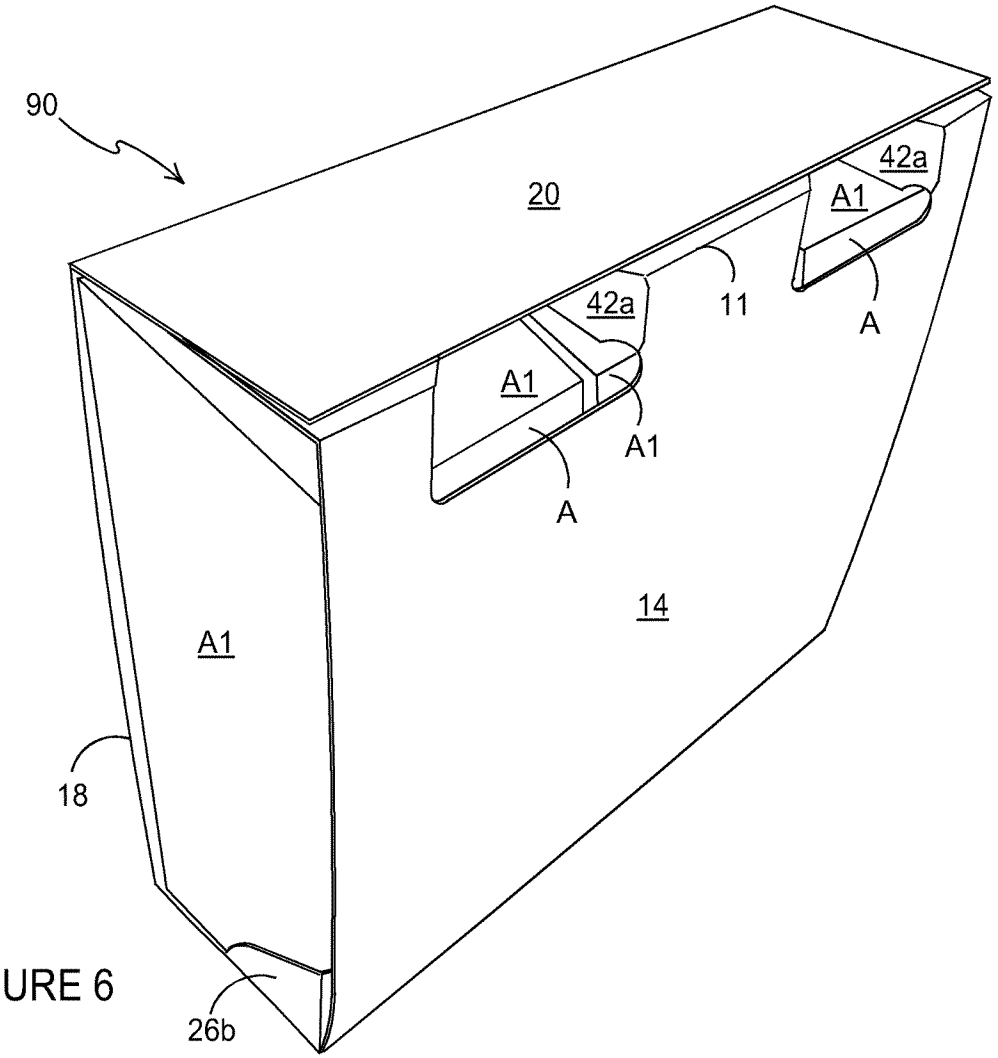
FIG. 6 is a perspective view from above of a carton formed from the blank of FIG. 1.
Figure 7:
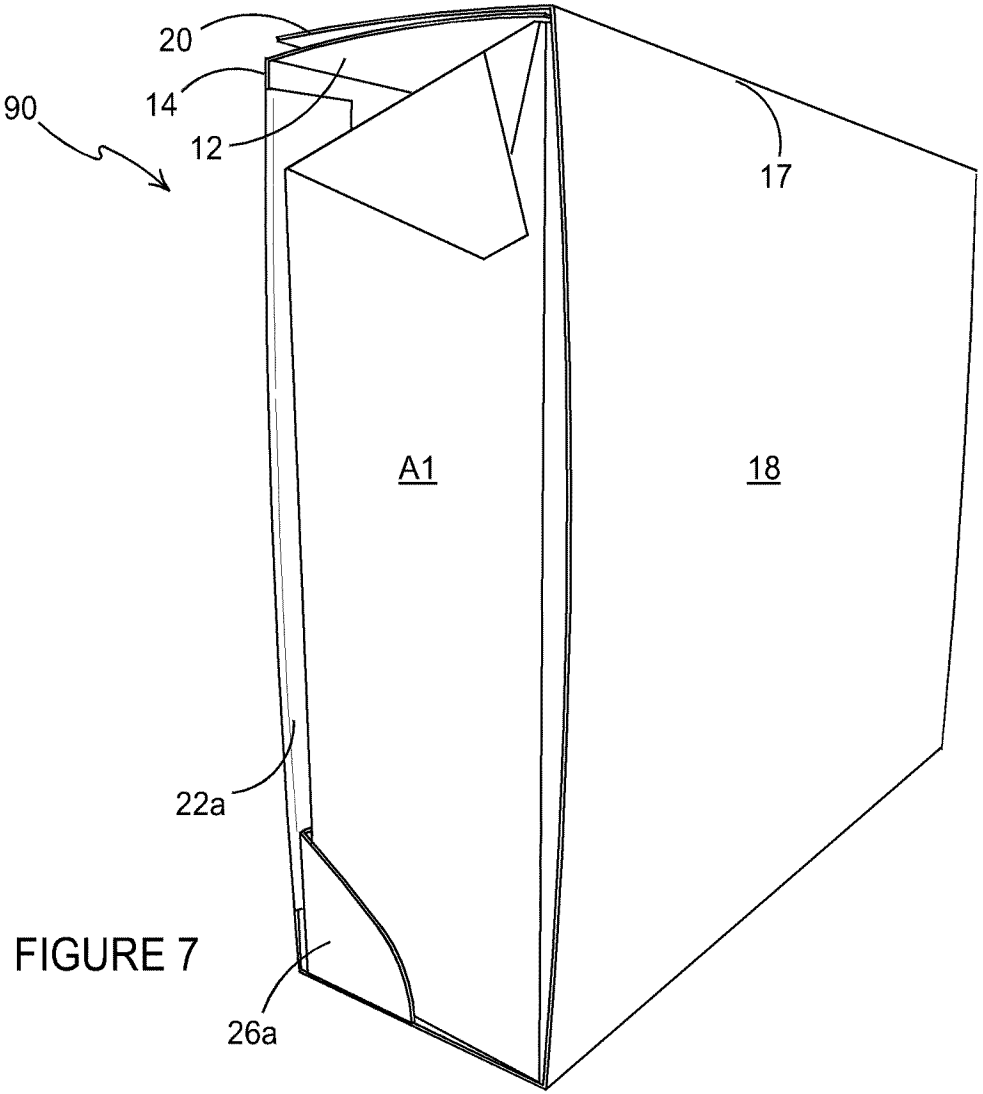
FIG. 7 is a perspective view of an end of the carton of FIG. 6.

Referring to FIG. 2, there is shown a perspective view of a blank 10 capable of forming a carton for a primary product such as, but not limited to, a brick package, hereinafter referred to as articles.

Figure 1:
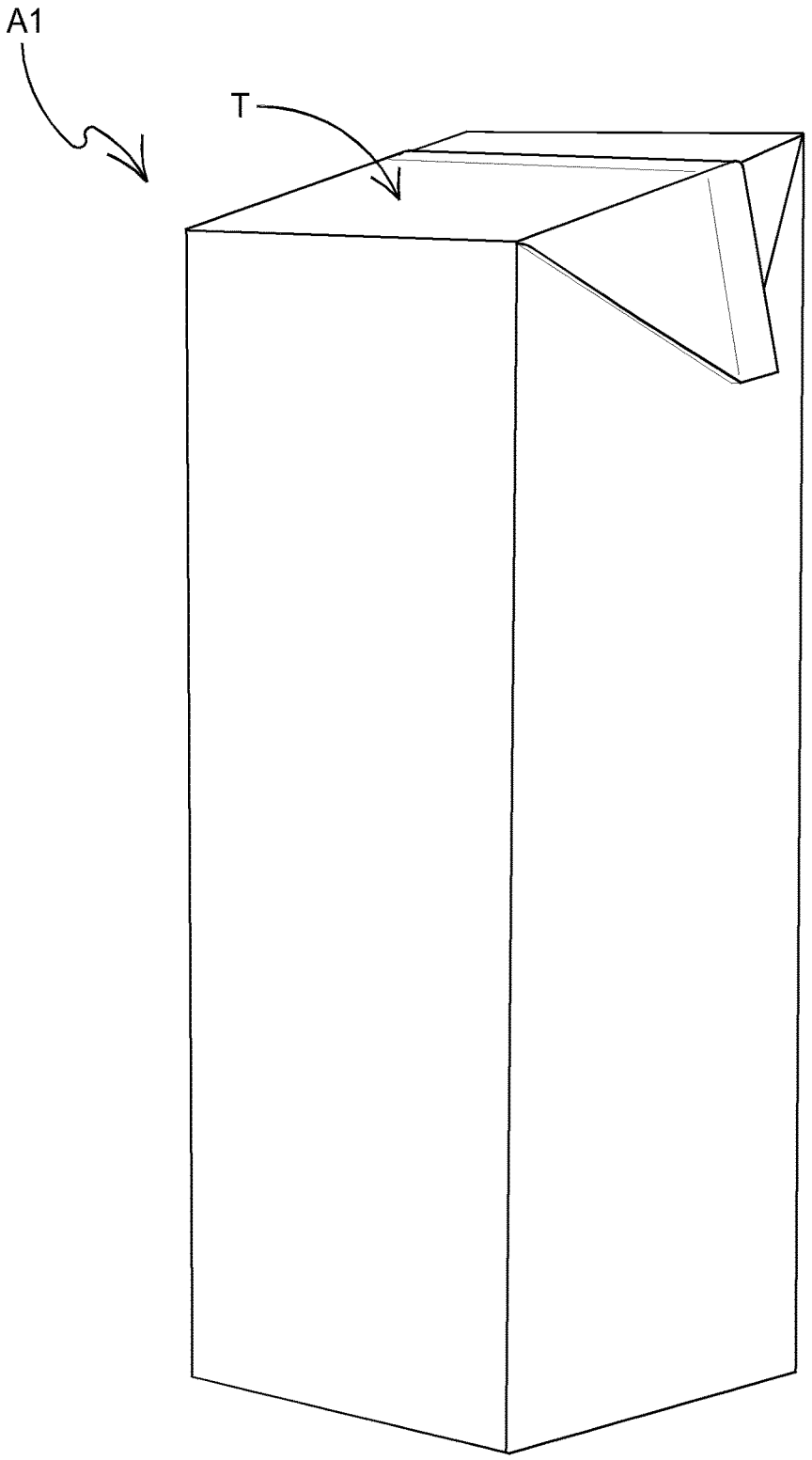
FIG. 1 is a perspective view of a first exemplary article to be packaged.

FIG. 1 shows a first exemplary primary product container A1, hereinafter referred to as first article A1. The first article A1 takes the form of a brick package having an inclined or sloping top panel T. It will be appreciated that containers having an un-flat, non-planar or inclined top panel present problems when stacking multiple containers.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Other exemplary containers include bottles (for example metallic, glass or plastics bottles), cans (for example aluminium cans), tins, pouches, packets and the like.

The blank is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blank is configured to form a carton or carrier for packaging an exemplary arrangement of exemplary articles. In a first illustrated exemplary embodiment, the arrangement is a 3×1 matrix or array and the articles are brick packages. The blank can be alternatively configured to form a carrier for packaging other types, number and size of article and/or for packaging articles in a different arrangement or configuration.

The blank 10 comprises a plurality of main panels hinged one to the next in a linear series. A first top panel 12 is hinged to a first side panel 14 by a hinged connection such as a fold line 11. The first side panel 14 is hinged to a base panel 16 by a hinged connection such as a fold line 13. The base panel 16 is hinged to a second side panel 18 by a hinged connection such as a fold line 15. The second side panel 18 is hinged to a second top panel 20 by a hinged connection such as a fold line 17.

The first side panel 14 comprises a first anchor panel **22*a* hinged to a first end edge thereof by a hinged connection such as a fold line 21*a*. A first lower end closure panel 26*a* is hinged to a first end edge of the first base panel 16 by a hinged such as a fold line 27*a*. A first web panel 24*a* hingedly connects the first lower end closure panel 26*a* to the first anchor panel 22*a*. The first web panel 24*a* is hinged to the first lower end closure panel 26*a* by a hinged connection such as a fold line 25*a* and the first web panel 24*a* is hinged to the first anchor panel 22*a* by a hinged connection such as a fold line 23***a*. The first web panel 24*a* is separated from the first side panel 14 by an aperture A1*a*.

The first anchor panel 22*a* comprises a recess R struck from an upper portion of a free end edge.

The first side panel 14 comprises a second anchor panel 22*b* hinged to a second end edge thereof by a hinged connection such as a fold line 21*b*; the second end edge opposes the first end edge. A second lower end closure panel 26*b* is hinged to a second end edge of the first base panel 16 by a hinged connection such as a fold line 27*b*. A second web panel 24*b* hingedly connects the second lower end closure panel 26*b* to the second anchor panel 22*b*. The second web panel 24*b* is hinged to the second lower end closure panel 26*b* by a hinged connection such as a fold line 25*b* and the second web panel 24*b* is hinged to the second anchor panel 22*b* by a hinged connection such as a fold line 23*b*. The second web panel 24*b* is separated from the second side panel 14 by an aperture A1*b*.

The second anchor panel 22*b* comprises a recess R struck from an upper portion of a free end edge.

The blank 10 comprises a pair of spacer or support structures S. The support structures S each comprise a pair of tabs 40*a*/42*a*, 40*b*/42*b*. A first tab 40*a*/42*a* is hinged to the first side panel 14 and to the first top panel 12. The first tab 40*a*/42*a* comprises a hinged connection such as a fold line 45*a* which defines in part an upper part 40*a* of the first tab 40*a*/42*a* which is hinged to the first top panel 12 by a hinged connection such as a fold line 41*a*, and defines in part a lower part 42*a* hinged to the first side panel 14 by a hinged connection such as a fold line 43*a*. A second tab 40*b*/42*b* is hinged to the first side panel 14 and to the first top panel 12. The second tab 40*b*/42*b* comprises a hinged connection such as a fold line 45*b* which defines in part an upper part 40*b* of the second tab 40*b*/42*b* which is hinged to the first top panel 12, by a hinged connection such as a fold line 41*b*, and defines in part a lower part 42*b* hinged to the first side panel 14 by a hinged connection such as a fold line 43*b*. The first tab 40*a*/42*a* is separated from the second tab 40*b*/42*b* by a cut line 49. An aperture A is struck from the first side panel 14 and defines a lower edge of each of the lower parts 42*a*, 42*b* of the first and second tabs 40*a*/42*a*, 40*b*/42*b*.

Turning to the construction of the carton as illustrated in FIGS. 3 to 10, it is envisaged that the carton can be formed by a series of sequential folding operations in a straight line machine so that the carton is not required to be rotated or inverted to complete its construction. The folding process is not limited to that described below and may be altered according to particular manufacturing requirements.

The base panel 16 is loaded with first articles A1. The first and second anchor panels 22*a*, 22*b* are folded about the fold lines 21*a*, 21*b* respectively to bring them into face contacting relationship with the first side panel 14. Folding the first and second anchor panels 22*a*, 22*b* about the fold lines 21*a*, 21*b* automatically folds the first and second lower end closure panels 26*a*, 26*b* about the fold lines 27*a*, 27*b* respectively.

The first and second tabs 40*a*/42*a*, 40*b*/42*b* of each of the support structures S are folded about the fold lines 41*a*, 43*a*, 41*b*, 43*b* respectively. Simultaneously, the first top panel 12 is at least partially folded about the fold line 11.

The first side panel 14 is then folded about fold line 13 to be substantially perpendicular to the base panel 16. The second side panel 18 is folded about fold line 15 to be substantially perpendicular to the base panel 16, either sequentially or simultaneously with the folding of the first side panel 14.

The first top panel 12 is folded about the fold line 11 to be substantially perpendicular to the first side panel 14. The upper parts 40*a*, 40*b* of the first and second tabs 40*a*/42*a*, 40*b*/42*b* are brought into contact with, or at least into close proximity to, the inner surface of the first top panel 12.

Glue or other adhesive treatment is applied to an inner surface of the second top panel 20 or to a corresponding region of the outer surface of the first top panel 12.

The second top panel 20 is folded about the fold line 17 to be configured in at least partial overlapping relationship with the first top panel 12. The second top panel 20 is secured to the first top panel 12.

The carton 90 as shown in FIGS. 6 to 10 forms a package with the first articles A1. The carton 90 has a composite top panel 20/12 formed by the first and second top panels 12, 20. The composite top panel 20/12 is substantially perpendicular to the first and second side walls 14, 18 and substantially parallel with the base panel 16. The composite top panel 20/12 is therefore substantially horizontal, when the base panel 16 is at rest upon a substantially horizontal surface. This is in contrast to the top panel T of the first article A1 which is inclined to the horizontal plane of the composite top panel 20/12. In this way the carton 90 provides a suitable surface for stacking multiple first articles A1 upon one another.

Figure 8:
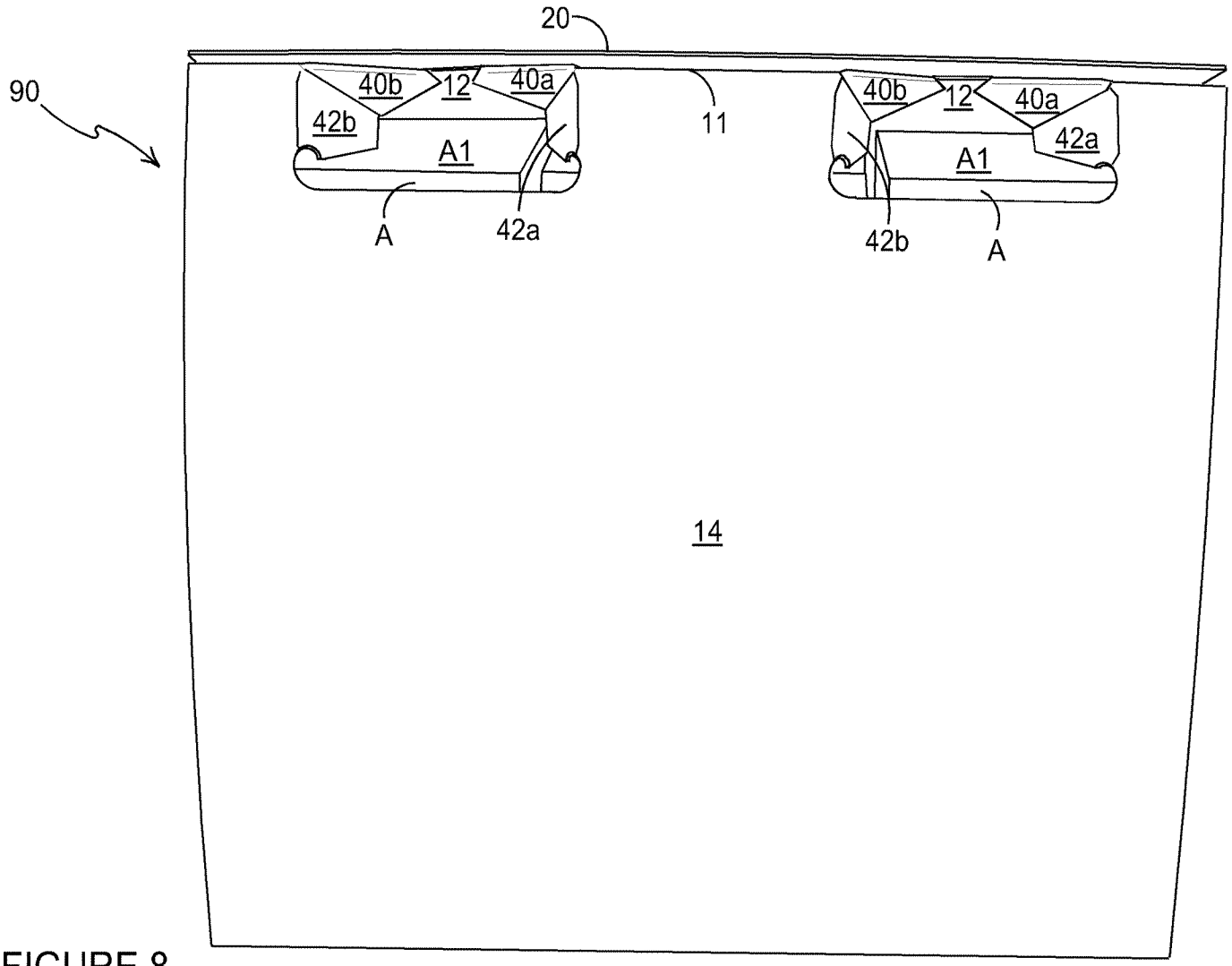
FIG. 8 is a side view of the carton of FIG. 6.
Figure 9:
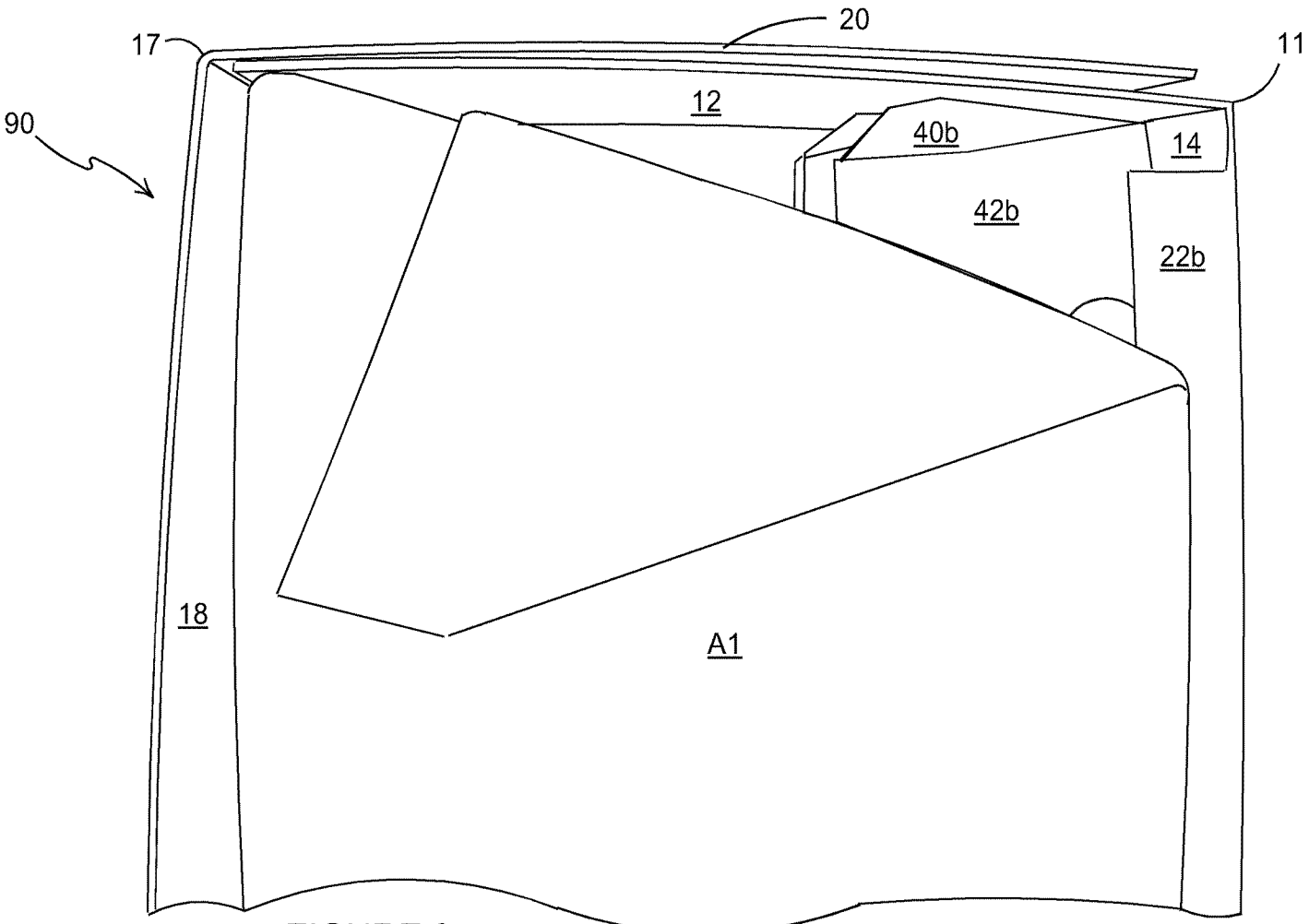
FIG. 9 is an end view of the carton of FIG. 6.
Figure 10:
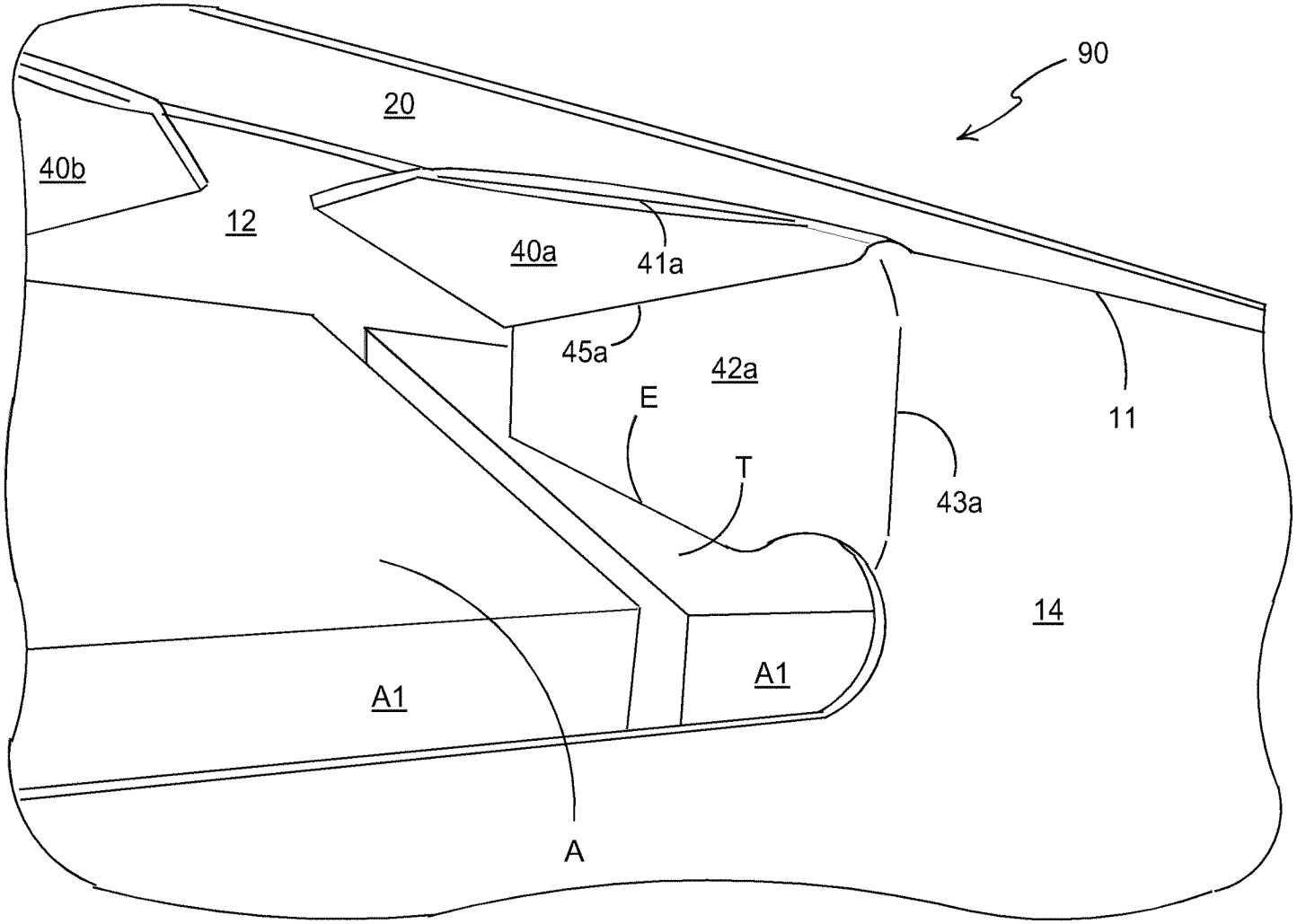
FIG. 10 is an enlarged perspective view of a spacer device when viewed externally.

The support structures S form a brace between the composite top panel 20/12 and the top panel T of the first articles A1. As best shown in FIGS. 8, 9 and 10 the lower parts 42*a*, 42*b* of the first and second tabs 40*a*/42*a*, 40*b*/42*b* are arranged to form a brace member between the composite top panel 20/12 and the top panel T of the first articles A1. A lower edge of each of the lower parts 42*a*, 42*b* of the first and second tabs 40*a*/42*a*, 40*b*/42*b* is in contact with the top panel T of the first articles A1. An upper edge of each of the lower parts 42*a*, 42*b* of the first and second tabs 40*a*/42*a*, 40*b*/42*b*, which is hinged to the upper parts of the first and second tabs 40*a*/42*a*, 40*b*/42*b*, is disposed in contact with, or in close proximity to, the inner surface of the composite top panel 20/12. In this way the lower parts 42*a*, 42*b* of the first and second tabs 40*a*/42*a*, 40*b*/42*b* transfer a load placed upon the composite top panel 20/12 to the first articles A1.

Referring now to FIGS. 11 and 13 to 18, there are shown alternative embodiments of the present invention. In the second and third illustrated embodiments, like numerals have, where possible, been used to denote like parts, albeit with the addition of the prefix "100" or "200" and so on to indicate that these features belong to the second embodiment or third embodiment respectively. The alternative embodiments share many common features with the first embodiment and therefore only the differences from the embodiment illustrated in FIGS. 2 to 10 will be described in any greater detail.

Figure 11:
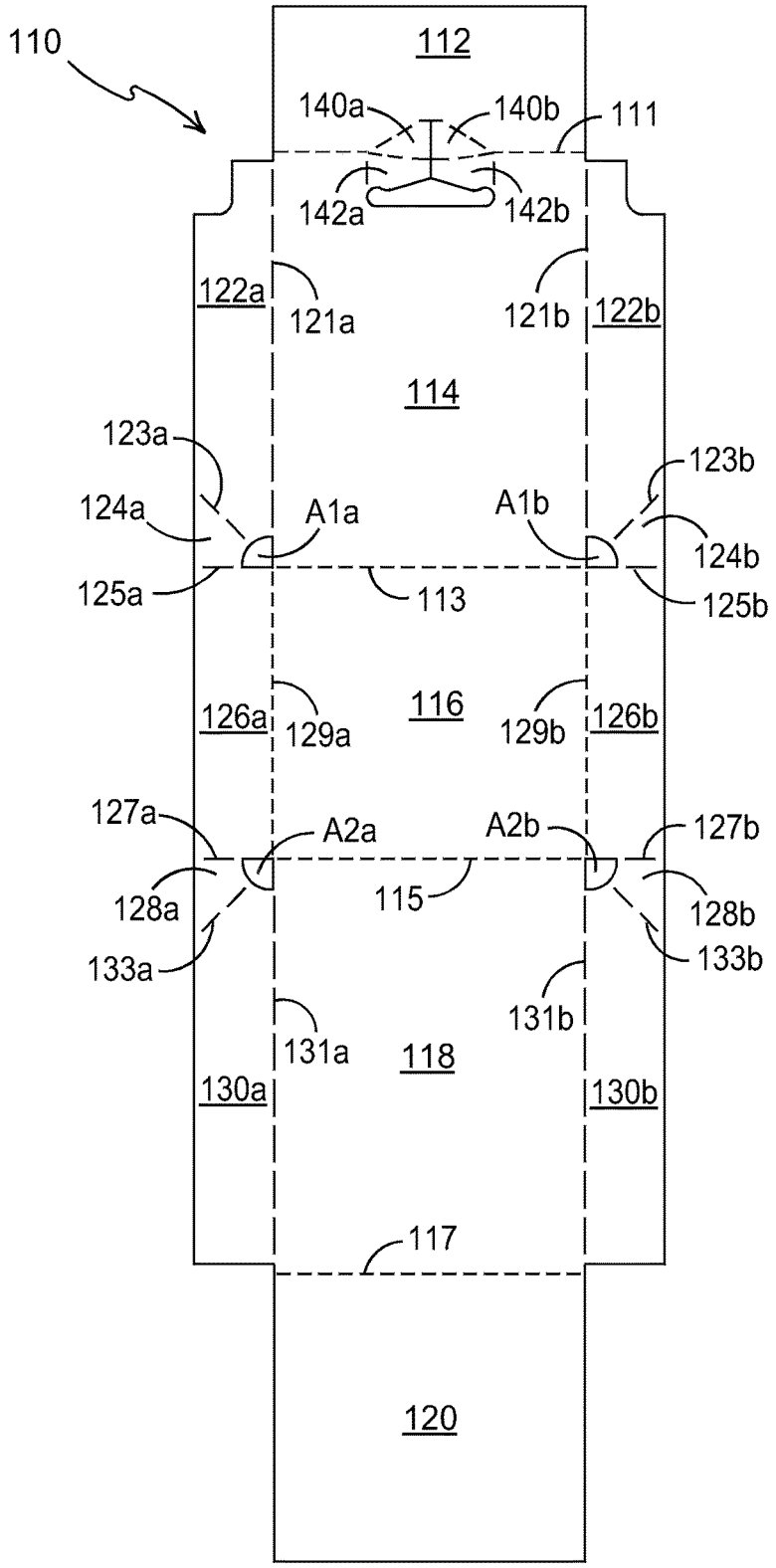
FIG. 11 is a plan view from above of a blank for forming a carton according to a second embodiment.
Figure 12:
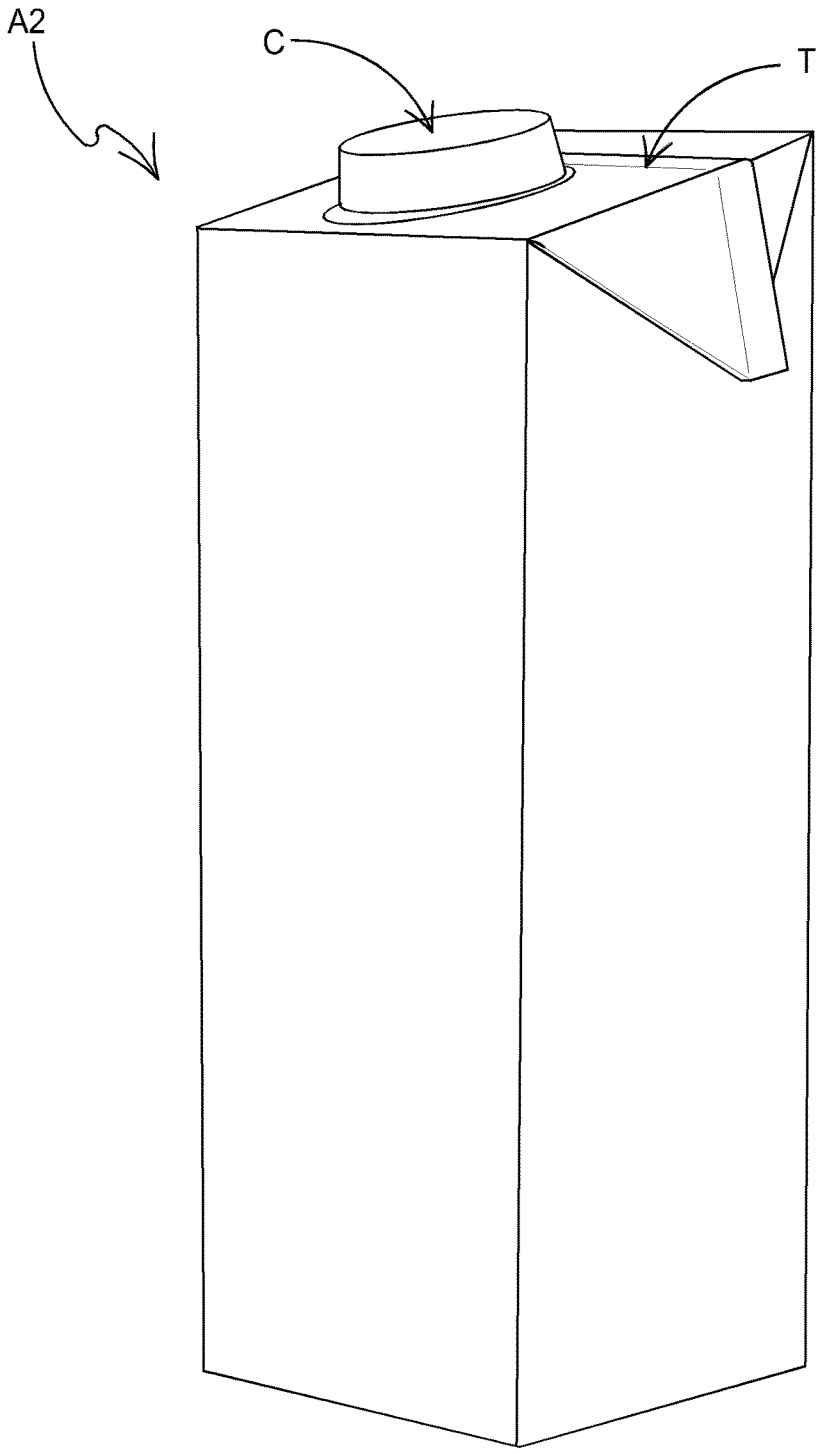
FIG. 12 is a perspective view of a second exemplary article to be packaged.
Figure 13:
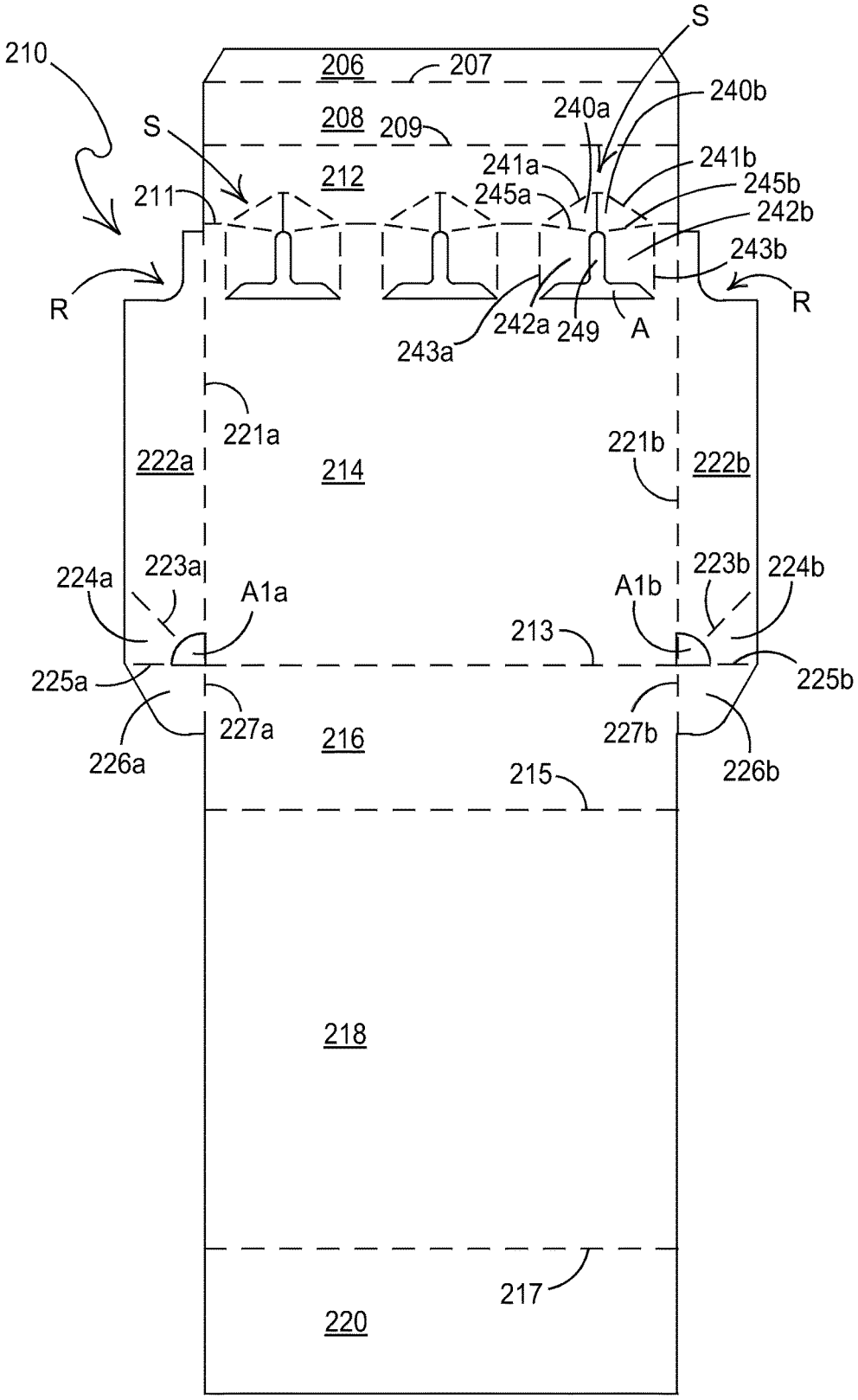
FIG. 13 is a plan view from above of a blank for forming a carton according to a third embodiment.
Figure 14:
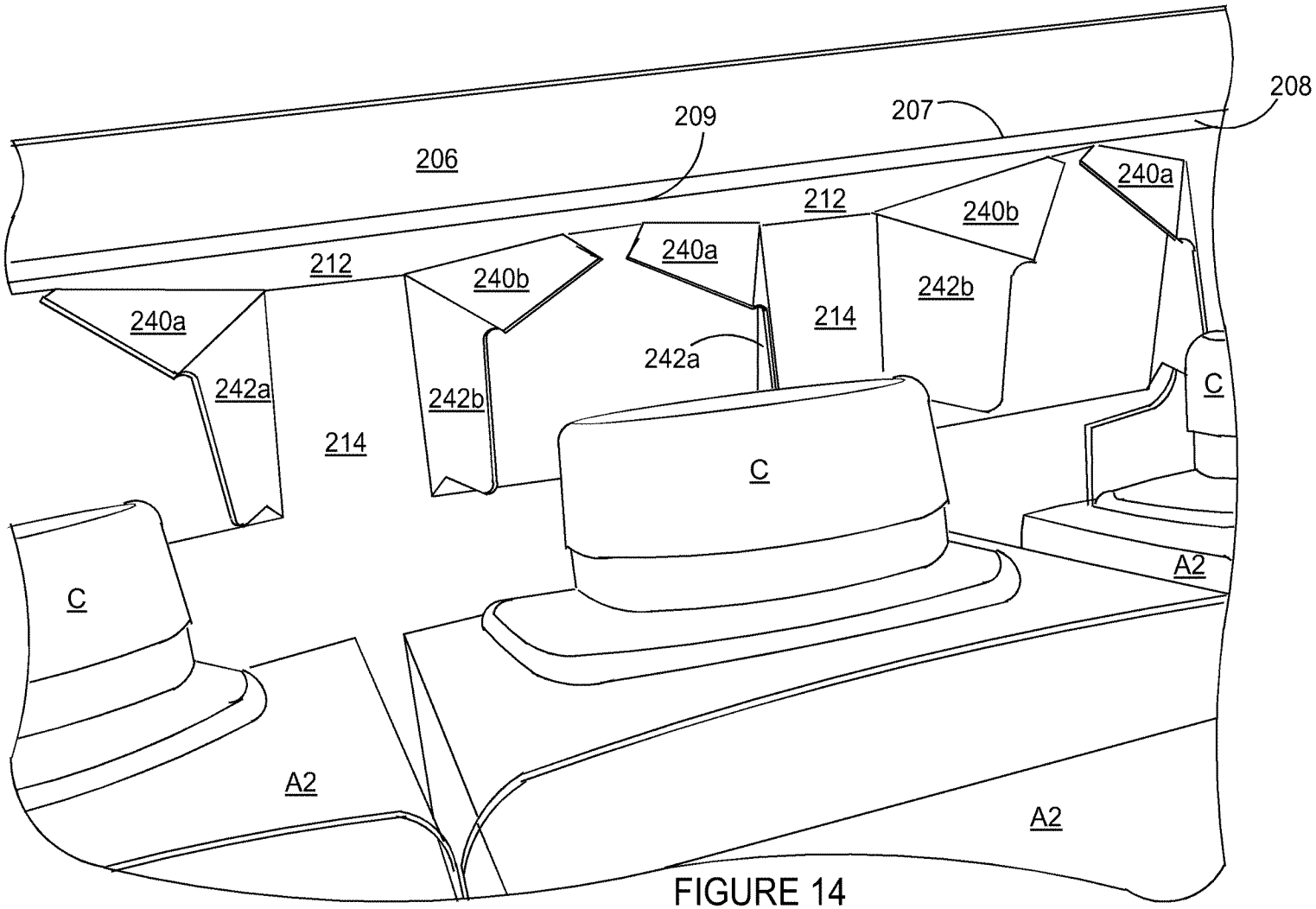
FIG. 14 is a perspective view, from inside, of a portion of the blank of FIG. 13 in a state of partial erection into a carton.

In the embodiment shown in FIG. 11, the blank 110 comprises only one support structure which is centrally disposed interrupting the fold line 111 between the first top panel 112 and the first side panel 114. The blank 110 may accommodate two first articles A1 in a 2×1 array or matrix. In alternative embodiments the blank 110 may be arranged to accommodate one second article A2 as illustrated in FIG. 12, wherein the support structure is arranged such that the first tab 140*a*/142*a* is disposed upon a first side of the closure device C and the second tab 140*b*/142*b* is disposed upon a second side of the closure device C, wherein the closure device C is positioned substantially between the first tab 140*a*/142*a* and the second tab 140*b*/142*b*.

The blank 110 comprises a first lower end closure panel 126*a* disposed on first side edge of the base panel 116 and hinged thereto by a hinged connection such as a fold line 129*a*. The first lower end closure panel 126*a* extends along the entire length of the base panel 116 and partially closes a tubular structure formed by the main panels 112, 114, 116, 118, 120. First lower end closure panel 126*a* is indirectly connected to a first anchor panel 122*a* via a first web panel 124*a*. First lower end closure panel 126*a* is hinged to the first web panel 124*a* by a hinged connection such as fold line 125*a*. First web panel 124*a* is hinged to the first anchor panel 122*a* by a hinged connection such as a fold line 123*a*. A first aperture A1*a* separates first web panel 124*a* from the first side panel 114. First lower end closure panel 126*a* is indirectly connected to a second anchor panel 130*a* via a second web panel 128*a*. First lower end closure panel 126*a* is hinged to the second web panel 128*a* by a hinged connection such as a fold line 127*a*. Second web panel 128*a* is hinged to the second anchor panel 130*a* by a hinged connection such as a fold line 133*a*. A second aperture A2*a* separates second web panel 128*a* from the second side panel 118.

The blank 110 comprises a second lower end closure panel 126*b* disposed on the second side edge of the base panel 116 and hinged thereto by a hinged connection such as a fold line 129*b*. The second lower end closure panel 126*b* extends along the entire length of the base panel 116 and partially closes a tubular structure formed by the main panels 112, 114, 116, 118, 120. Second lower end closure panel 126*b* is indirectly connected to a third anchor panel 122*b* via a third web panel 124*b*. Second lower end closure panel 126*b* is hinged to the third web panel 124*b* by a hinged connection such as a fold line 125*b*. Third web panel 124*b* is hinged to the third anchor panel 122*b* by a hinged connection such as a fold line 123*b*. A third aperture A1*b* separates third web panel 124*b* from the first side panel 114. Second lower end closure panel 126*b* is indirectly connected to a fourth anchor panel 130*b* via a fourth web panel 128*b*. Second lower end closure panel 126*b* is hinged to the fourth web panel 128*b* by a hinged connection such as a fold line 127*b*. Fourth web panel 128*b* is hinged to the fourth anchor panel 130*b* by a hinged connection such as a fold line 133*b*. A fourth aperture A2*b* separates fourth web panel 128*b* from the second side panel 118.

Recesses are struck from each of the first and third anchor panels 122*a*, 122*b*. The recesses are configured to accommodate the support structure. In particular, the recesses are arranged such that when the first and third anchor panels 122*a*, 122*b* are folded into face contacting relationship with the first side panel 114 the first and second tabs 140*a*/142*a*, 140*b*/142*b* can be folded internally of the carton. In this way, the first and third anchor panels 122*a*, 122*b* do not interfere with erection of the support structure.

FIG. 12 illustrates a second exemplary article A2. The second article A2 again takes the form of a brick package having an inclined or sloping top panel T. The second article A2 comprises a closure device or dispenser C which is mounted to the external face of the top panel T. It is envisaged that the dispenser C may be removable to allow dispensing of the primary product contained within the second article A2. The second article A2 may be reclosable or resealable by reattaching the closure device C.

FIGS. 13 to 18 illustrate a blank 210 for forming a carton 290 for packaging the second article A2.

The blank 210 comprises a plurality of main panels hinged one to the next in a linear series. A first top panel 212 is hinged to a first side panel 214 by a hinged connection such as a fold line 211. The first side panel 214 is hinged to a base panel 216 by a hinged connection such as a fold line 213. The base panel 216 is hinged to a second side panel 218 by a hinged connection such as a fold line 215. The second side panel 218 is hinged to a second top panel 220 by a fold line 217. A first brace panel 208 is hinged to the first top panel 212 by a hinged connection such as a fold line 209. A second brace panel 206 is hinged to the first brace panel 208 by a hinged connection such as a fold line 207.

The blank 210 comprises three spacer or support structures S. The support structures S each comprise a pair of tabs 240*a*/242*a*, 240*b*/242*b*. A first tab 240*a*/242*a* is hinged to the first side panel 214 and to the first top panel 212. The first tab 240*a*/242*a* comprises a hinged connection such as a fold line 245*a* which defines in part an upper part 240*a* of the first tab 240*a*/242*a*, which is hinged to the first top panel 212 by a hinged connection such as a fold line 241*a*, and defines in part a lower part 242*a* hinged to the first side panel 214 by a hinged connection such as a fold line 243*a*. A second tab 240*b*/242*b* is hinged to the first side panel 214 and to the first top panel 212. The second tab 240*b*/242*b* comprises a hinged connection such as a fold line 245*b* which defines in part an upper part 240*b* of the second tab 240*b*/242*b*, which is hinged to the first top panel 212 by a hinged connection such as a fold line 241*b*, and defines in part a lower part 242*b* hinged to the first side panel 214 by a hinged connection such as a fold line 243*b*. The first tab 240*a*/242*a* is separated from the second tab 240*b*/242*b* by a cut line 249. An aperture A is struck from the first side panel 214 and defines a lower edge of each of the lower parts 242*a*, 242*b* of the first and second tabs 240*a*/242*a*, 240*b*/242*b*.

The first and second anchor panels 222*a*, 222*b* each comprise a recess R configured and arranged to accommodate the endmost support structures S. The recesses R are larger and deeper than the previous embodiments since the endmost support structures S are arranged in closer proximity to the end edges of the first side panel 214.

Figure 15:
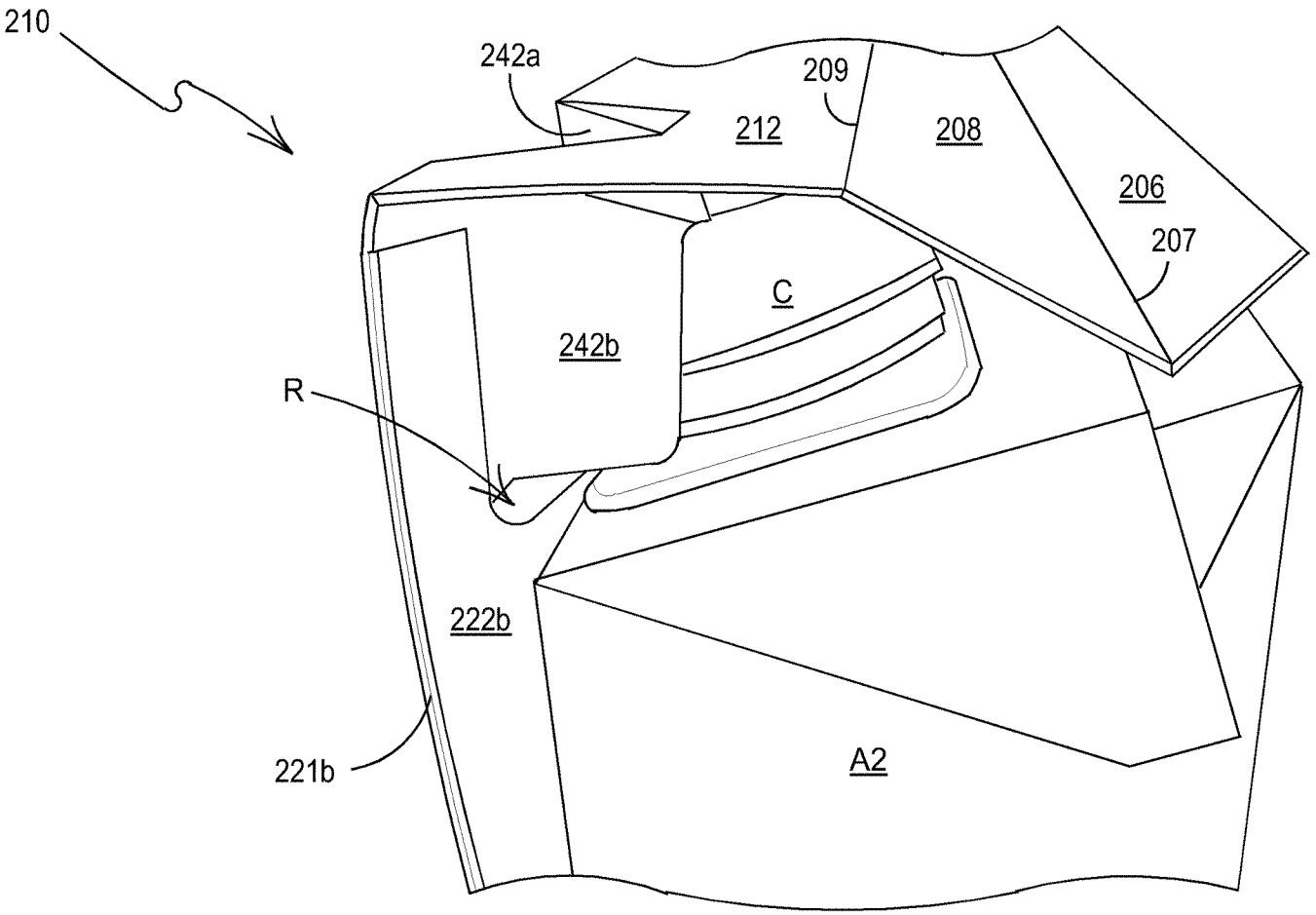
FIG. 15 is a perspective view from one end of a portion of the blank of FIG. 13 in a state of partial erection into a carton.
Figure 16:
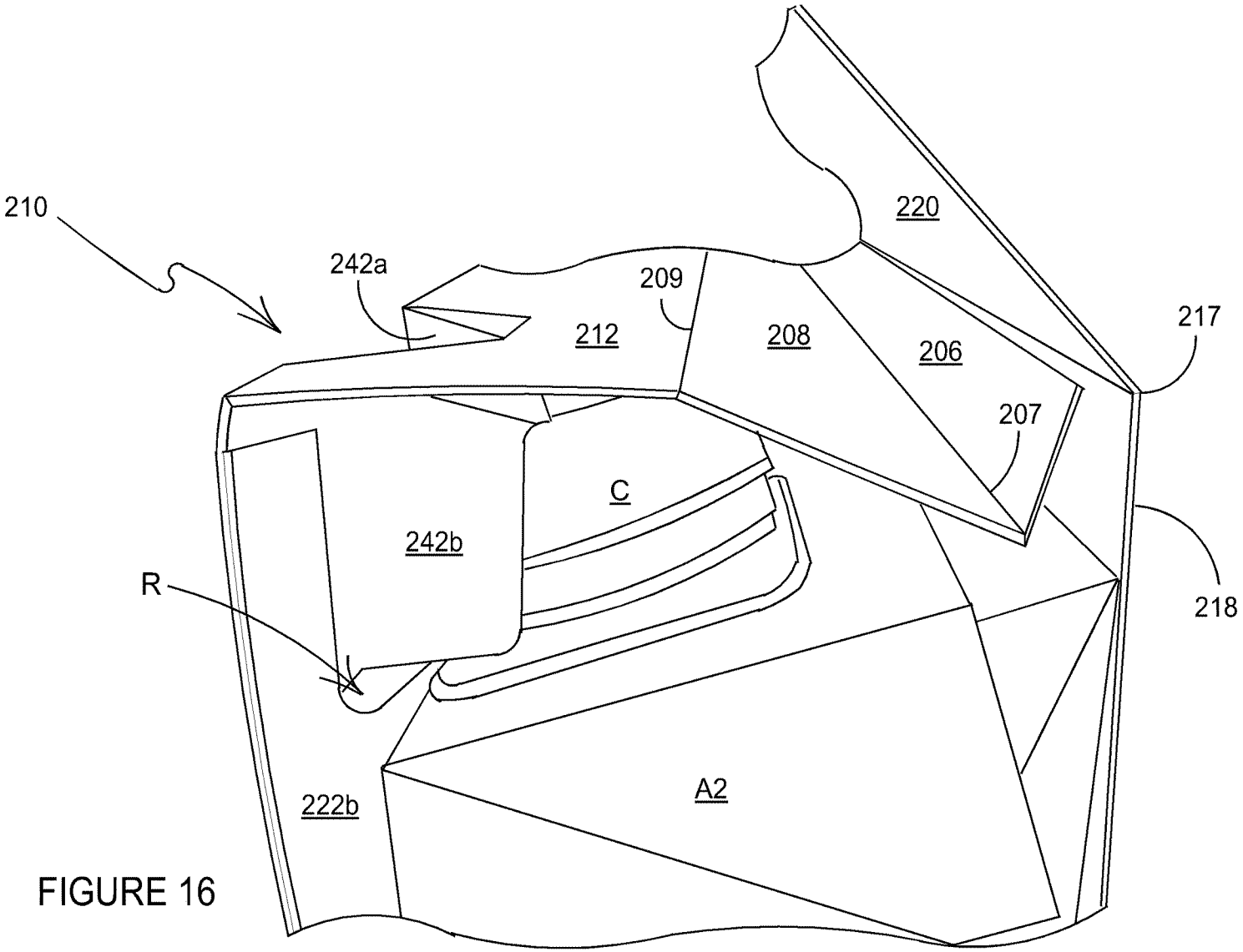
FIG. 16 is a perspective view from one end of a portion of the blank of FIG. 13 in a state of partial erection into a carton.
Figure 17:
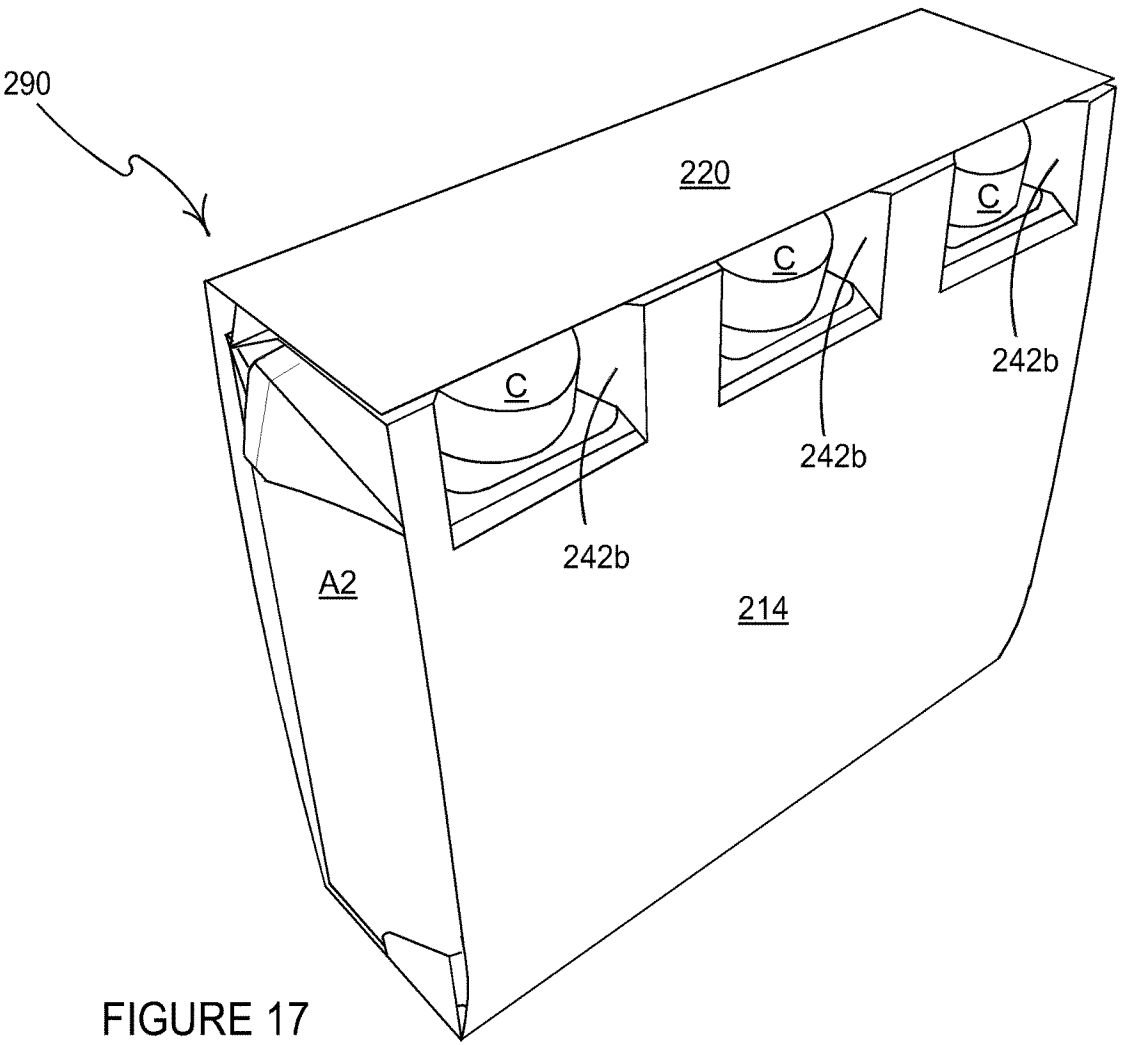
FIG. 17 is a perspective view from above of a carton formed from the blank of FIG. 13.

The method of assembling the blank 210 comprises the additional steps of erecting the brace structure formed from the first and second brace panels 208, 206. Once the first top panel 212 is folded about the fold line 211 over the closure devices C the first brace panel 208 is folded about fold line 209 towards the top panel T of the second article A2 as illustrated in FIG. 15. The second brace panel 206 is folded about fold line 207 away from the top panel T of the second article A2 as illustrated in FIG. 15. The second top panel 220 is then folded about fold line 217, such that a free end edge of the second brace panel 206 is substantially located in the crease formed by folding the second top panel 220 with respect to the second side panel 218. In this way the second top panel 220 is secured to the first top panel 212. The first and second brace panels 208, 206 form a substantially V-shaped structure beneath the second top panel 220, which V-shaped structure supports the second top panel 220 and serves to transfer a load placed upon the second top panel 220 to the top panel T of the second articles A2. The V-shaped structure spreads the load across each of the top panels T of each of the second articles A2 being packaged.

Figure 18:
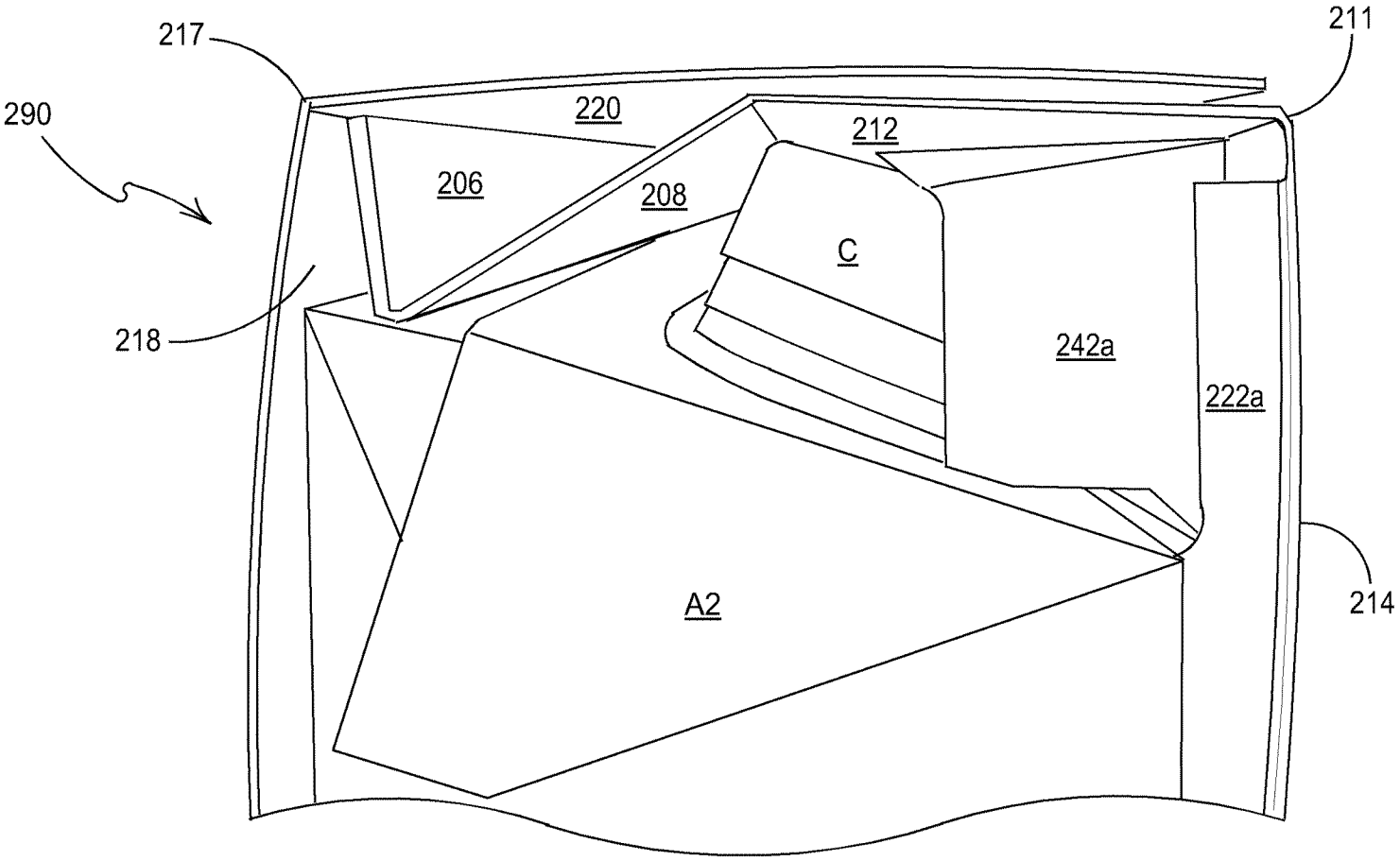
FIG. 18 is an end view of the carton of FIG. 17.

The first and second brace panels 208, 206 and the support structures S prevent or at least reduce the load or force applied to the closure device C when a load is applied to the composite top panel 220/212 of the carton 290, for example when stacking cartons 290 on top of each other as illustrated in FIG. 18.

It can be appreciated that various changes may be made within the scope of the present invention. For example, the size and shape of the panels and apertures may be adjusted to accommodate articles of differing size or shape.

It will be recognised that as used herein, directional references such as "top", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel. therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A package comprising a carton and one or more articles, the carton comprising a top panel, a base panel, a first side wall and a second side wall, the first side wall comprising at least one tab hingedly connected thereto, the at least one tab comprising a first tab hinged to the first side wall and a second tab hinged to the first side wall in opposition to the first tab, each of the first and second tabs being configured to provide a support structure for facilitating stacking of the carton, each of the first and second tabs comprising a first portion hinged to the first side wall and a second portion hinged to the first portion and to the top panel, the first portion having a lower edge in contact with an inclined top panel of an article and comprising an upper edge in contact with an inner surface of the top panel of the carton so as to support the top panel of the carton above the inclined top panel of the article, wherein the lower edge of the first portion angles upwardly toward an interior of the carton.

2. A package according to claim 1 wherein the carton comprises a lower end closure panel for at least partially closing an end of the carton, the lower end closure panel being hinged to an anchor panel for holding the lower end closure panel in an erected position.

3. A package according to claim 2 wherein the lower end closure panel is hinged to the anchor panel by a web panel.

4. A package according to claim 2 wherein the anchor panel comprises a recess for accommodating the at least one tab when folded internally of the carton.

5. A package according to claim 1 wherein the carton comprises a first brace panel and a second brace panel configured to form a V-shaped structure between the inclined top panel of the article and the inner surface of the top panel of the carton.

6. A package according to claim 1 wherein the one or more articles comprise an inclined top panel.

7. A package according to claim 1 wherein the one or more articles comprise a dispenser mounted to an outer surface of the inclined top panel.

8. A carton for packaging one or more articles, the carton comprising a top panel, a base panel, a first side wall and a second side wall, the carton comprising a support structure for facilitating stacking of the carton, the support structure comprising a first tab hinged to the first side wall and a second tab hinged to the first side wall in opposition to the first tab, each of the first and second tabs comprising a first portion hinged to the first side wall and a second portion hinged to the first portion and to the top panel, the first portion having a lower edge for being disposed in contact with an inclined top panel of an article and an upper edge for being disposed in contact with an inner surface of the top panel of the carton for supporting the top panel of the carton above the inclined top panel of the article, wherein the lower edge of the first portion angles upwardly toward an interior of the carton.

9. A carton according to claim 8 wherein the carton comprises a lower end closure panel for at least partially closing an end of the carton, the lower end closure panel being hinged to an anchor panel for holding the lower end closure panel in an erected position.

10. A carton according to claim 9 wherein the lower end closure panel is hinged to the anchor panel by a web panel.

11. A carton according to claim 9 wherein the anchor panel comprises a recess for accommodating the first tab when folded internally of the carton.

12. A carton according to claim 8 wherein the carton comprises a first brace panel and a second brace panel configured to form a V-shaped structure between the inclined top panel of the article and the inner surface of the top panel of the carton.

13. A blank for forming a carton comprising a plurality of main panels hinged one to the next in a linear series, the plurality of panels forming a top panel, a base panel, a first side wall and a second side wall in a set-up carton, the blank comprising a support structure for facilitating stacking of the carton, the support structure comprising a first tab hinged to the first side wall and a second tab hinged to the first side wall in opposition to the first tab, each of the first and second tabs comprising a first portion hinged to the first side wall and a second portion hinged to the first portion and to the top panel, the first portion having a lower edge for being disposed in contact with an inclined top panel of an article and an upper edge for being disposed in contact with an inner surface of the top panel of the carton for supporting the top panel of the carton above the inclined top panel of the article, wherein the lower edge of the first portion is configured to angle upwardly toward an interior of the set-up carton.

14. A blank according to claim 13 wherein the plurality of panels comprises a first top panel and a second top panel for being disposed in at least partially overlapping relationship to form a composite top panel in a set-up carton.

15. A blank according to claim 13 wherein the plurality of panels comprises a first brace panel and a second brace panel for forming a V-shaped bracing structure in a set-up carton.

16. A blank according to claim 14 wherein the first brace panel is hinged to the first top panel and the second brace panel is hinged to the first brace panel.

* * * * *